US005490947A

United States Patent [19]

Cioffe

[11] Patent Number: 5,490,947

[45] Date of Patent: Feb. 13, 1996

[54] METHOD FOR CLEANING FIREARMS AND OTHER METAL ORDNANCE

[76] Inventor: Anthony Cioffe, 5010 Fillmore St., Hollywood, Fla. 33021

[21] Appl. No.: 369,320

[22] Filed: Jan. 6, 1995

Related U.S. Application Data

[63] Continuation of Ser. No. 118,670, Sep. 10, 1993, abandoned.

[51] Int. Cl.[6] ..... C11D 3/39; C11D 3/43; C11D 17/08; C23G 1/08

[52] U.S. Cl. ..... 252/100; 252/95; 252/104; 252/173; 252/174.19; 252/550; 134/2; 134/3; 134/20; 134/40

[58] Field of Search ..... 134/3, 2, 20, 40; 252/95, 104, 173, 100, 550

[56] References Cited

U.S. PATENT DOCUMENTS

| | | | |
|---|---|---|---|
| 1,484,690 | 2/1924 | Walker et al. | 252/90 |
| 1,535,124 | 4/1925 | Laughlin | 134/2 |
| 1,614,129 | 1/1927 | Hoskins | 134/7 |
| 2,882,237 | 4/1959 | Mahoney | 252/186 |
| 3,645,789 | 2/1972 | Mandelkow et al. | 134/2 |
| 3,738,867 | 6/1973 | Franz | 134/2 |
| 4,178,189 | 12/1979 | Mancini | 134/6 |
| 4,315,780 | 2/1982 | Rupp et al. | 134/7 |
| 4,806,274 | 2/1989 | Crouse | 252/548 |
| 4,844,886 | 7/1989 | Hartmann | 424/62 |
| 4,980,152 | 12/1990 | Frazier | 424/52 |
| 5,047,249 | 9/1991 | Rothman | 424/543 |
| 5,174,990 | 12/1992 | Douglas | 424/53 |
| 5,202,523 | 4/1993 | Grossman | 42/95 |
| 5,244,593 | 9/1993 | Roselle | 252/99 |
| 5,271,860 | 12/1993 | Schwadtke | 252/96 |

OTHER PUBLICATIONS

*The Chemical Formulary, vol. VI.,* Edite by H. Bennett, published by the Chemical Publishing Co., New York, 1943, No month available p. 494.

No month available McCutcheon's Emulsifier's & Detergents 1982 North American Edition, published by MC Publishing Co., 175 Rock Road, Glen Rock, N.J. 07452, pp. 251–252.

*Primary Examiner*—Dennis Albrecht

*Attorney, Agent, or Firm*—Sherman and Shalloway

[57] ABSTRACT

The present invention is directed to a cleaner for removing gunpowder residues from the surfaces of firearms and to a method of use of such a cleaner. The cleaner comprises a liquid solution of an oxidizing agent, a liquid detergent surfactant, a scenting agent and an alcohol which is applied to the surfaces of the firearm, preferably with a mild abrasive action. In its preferred form the oxidizing agent is a 3% by weight solution of hydrogen peroxide and is present in the cleaner in an amount of 95% to 99% by weight, the liquid detergent surfactant is sodium dodecyl sulfate in an amount of 0.5% to 1% by weight to the total cleaner solution and the scenting agent is citric acid in an amount of 0% to 1% by weight. The alcohol may be any normal alcohol and is present in an amount of 0.5% to 3% by weight. A coloring agent may also be added.

6 Claims, No Drawings

METHOD FOR CLEANING FIREARMS AND OTHER METAL ORDNANCE

This application is a continuation of application Ser. No. 08/118,670, filed Sep. 10, 1993, now abandoned.

BACKGROUND OF THE INVENTION

This invention relates to a material and method for use in cleaning interior and exterior surfaces of firearms to remove the residues left on those surfaces by gunpowder when the firearm is used. More particularly, it relates to a solution for use in cleaning the firearm whereby the residues are loosened from the surfaces of the firearm and are suspended in the solution for removal from the firearm.

When firearms such as pistols, rifles and other small arms are fired, there is deposited within the chambers and barrel, as well as on adjacent exterior surfaces, residue left by the burning of the primer charge, the gunpowder propellant and by the passage of the bullet through the barrel. If not removed, these residues will build up over time to the extent that the efficiency and utility of the firearm is significantly decreased. The proper and regular cleaning of firearms is an important factor in keeping them accurate and dependable.

The residues left on firearms include grease and other lubricants from bullets or cartridges, carbon from the burning of the gunpowder propellant, and metallic deposits from the bullet. The current method of cleaning these residues from a firearm involves the use of strong solvents, and the like, which break down the residues. However, these solvents may also have a deleterious effect on the metal parts of the firearm such that, over time, the metal is etched or becomes brittle to the point where accuracy is affected or the firearm becomes unreliable. In addition, the currently used cleaners rapidly decompose and loose strength if not properly stored.

In the current method of cleaning firearms a clean cotton pad is dipped into the solvent and run back and forth through the bore of the barrel and cylinders and across any other surfaces to be cleaned. Next, a brush of the same calibre as the firearm is scrubbed vigorously through the bore and the cylinders, the action of the solvent and the scrubbing serving to loosen the residues. Additional clean pads are run through the bore and cylinders to remove the loosened residues and to dry the surfaces following which a protective oil is applied.

SUMMARY OF THE INVENTION

It is an object of this invention to provide a cleaning solution which will loosen and remove the residues left in a firearm and which overcomes the disadvantages of prior cleaners.

It is a further object of this invention to provide a cleaning solution for firearms which is inexpensive and which may be mixed from readily available ingredients.

It is a still further object of this invention to provide a cleaning solution for firearms which may be used in a conventional manner without the need of specialized equipment.

Other objects and advantages will become evident from the following description.

The present invention provides a cleaner for removing gunpowder residues from the surfaces of firearms and a method of using such a cleaner. The cleaner comprises a liquid solution of a peroxide oxidizing agent, a liquid detergent surfactant, a scenting agent and an alcohol which is applied to the surfaces of the firearm, preferably with a mild abrasive action. In its preferred form the oxidizing agent is a 3% by weight aqueous solution of hydrogen peroxide and comprises 95% to 99% by weight of the cleaner, the liquid detergent surfactant is sodium dodecyl sulfate in an amount of 0.5% to 1% by weight to the total cleaner solution and the scenting agent is citric acid in an amount of 0% to 1% by weight. The alcohol may be any normal alcohol, for example ethanol or isopropyl alcohol, and is present in an amount of 0.5% to 3% by weight.

DETAILED DESCRIPTION OF THE INVENTION

The present invention provides a cleaner for use in the cleaning of firearms and the removal of the residues left by the burning of gunpowder ,and similar propellants, ie. black powder, as well as other materials, such as lubricants and the like, left by the passage of bullets through the firearm. The cleaner comprises an oxidizing agent, a liquid detergent surfactant and an alcohol all in a liquid solution which may be readily applied to the surfaces of a firearm, preferably by means of a cloth or pad. As optional ingredients, a coloring agent and/or a scenting agent may be added.

While the cleaning composition of this invention is especially useful in removing gunpowder or propellant residue, especially black powder residue from firearms of all types, including musket or breech-loading guns, rifles, pistols and the like, it is also useful for cleaning propellant residues from any metal surface including, for example, rocket and bomb casings, propellant/gunpowder cartridge casings, bullets, and the like.

As oxidizing agent, the organic and inorganic peroxides are preferred, with hydrogen peroxide being especially preferred. The oxidizing agent provides both a chemical oxidation of the residues and a mechanical foaming action which breaks up the residues and lifts them from the surfaces of the firearm. The oxidation reaction principally occurs on the carbon residue and emollients which are left by the burning of gunpowder and similar propellants. These residues also serve to bind other debris and hold it in place within the firearm so that the break up of the residues will also loosen such debris so that it too can be removed. Hydrogen peroxide is preferred for its simplicity and ready availability in standard strengths and the inventor herein has found that the commercially available 3% by weight solution of hydrogen peroxide is particularly effective in the present cleaner, although other strengths of solution may be used.

An amount of a liquid detergent surfactant may be included in the cleaner to help promote the foaming action and to serve as an emulsifying agent. The amount of the surfactant included in the cleaner is from 0.5% to 3% by weight of the total cleaner, preferably 0.5% to 1%. The surfactant, when present, helps to solubilize the residues loosened by the action of the hydrogen peroxide and to suspend any particulates. Furthermore, the foaming action of the detergent surfactant together with the foaming produced by the oxidation of the residues by the hydrogen peroxide increases the mechanical effect of the cleaner to break up and lift the residues from the surfaces of the firearm. As surfactants, the anionic surfactants are preferred although high foaming non-ionic surfactants may also be used. A particularly preferred class of anionic surfactants are the alkali metal, long chain, aliphatic sulfates, such as sodium dodecyl sulfate and sodium lauryl sulfate. The anionic surfactant is preferably included in the cleaner as a liquid to ensure full mixing with the hydrogen peroxide solution. Other useful anionic surfactants include, for example, alkali metal soaps such as sodium, potassium, ammonium and alkanol-ammonium salts of higher fatty acids containing from about 8 to about 20 carbon atoms, such as soaps derived from coconut oil and tallows; alkali metal $C_8$–$C_{20}$ alkyl benzene sulfonates; sodium alkyl glyceryl ether sulfonates; and the like.

The alcohol may be included in an amount of up to 3% by weight of the total cleaner to suspend and solubilize the grease and other lubricants which are left by the passage of bullets through the barrel. Preferably the alcohol is present in an amount of 0.5% to 3%. Any normal alcohol, e.g. ethanol, may be used, however, isopropyl alcohol is preferred.

Other optional ingredients which may be added to the cleaner include coloring agents and scenting agents. In the case of the coloring agents, they may be FDA approved food colorings or other colorants which will not react with the other ingredients. Particular colors may be used to signify a particular strength of the cleaner which may be a function of the strength or type of the oxidizing agent or to signify the ratio of oxidizing agent, surfactant and alcohol. When used with the scenting agent, the color may also be an indication of the particular scent imparted to the cleaner by the scenting agent. The amount of coloring agent added is preferably minimal and should be just enough to give the desired shade to the cleaner.

With regard to the scenting agent, this may be any compound which will mask the odor of the oxidizer without excessive reaction therewith. Particularly preferred scenting agents are the citrus oils and citric acid which, in addition to masking the odor of the oxidizing agent, exhibit the capability of retarding or preventing rust formation on the metal surfaces of the firearm. Perfumes or other odor masking ingredients may also be used. When it is to be included, the scenting agent will preferably be present in an amount of up to 1% by weight of the total cleaner, such as about 0.01% to 1% by weight, preferably 0.02% to 0.8% by weight.

In use, the cleaner of the present invention is applied, by any suitable means, to the surfaces of the firearm or other metallic surface to be cleaned and is preferably given sufficient time for the oxidizing agent to work on the residues. Usually, however, only a few seconds are required, depending on the amount of residue build-up. Preferably, the cleaner is applied with a clean cloth or pad and is allowed to sit for a few seconds to about 30 seconds or more, after which the surfaces may be scrubbed with a brush or mildly abrasive pad as are normally used in cleaning firearms. However, it is one of the advantages of the present composition that scrubbing or brushing is not generally necessary. The cleaner may also be applied at the same time that the surfaces are scrubbed by first applying the cleaner to the brush or abrasive pad then using the brush or abrasive pad to scrub the firearm. After scrubbing, the firearm may be rinsed or wiped clean to remove the cleaner and the loosened residue and the firearm is then, preferably,-lightly oiled to prevent rusting of the metal. In a further method of use, the cleaner may be poured into the barrel of a firearm in which the breech has been closed by a plug or other means. Alternatively, the firearm, or parts thereof, may be immersed in a bath of the cleaner for a period of time to allow the cleaner to work and loosen the residue after which the firearm may be scrubbed and then rinsed or wiped clean and oiled.

The cleaner of this invention has the advantage of being economical as it can be mixed from readily available ingredients. In addition, it does not adversely react with the metal of the firearm so as to weaken or otherwise cause deterioration of the firearm.

Although the present invention has been described with respect to specific details of certain embodiments thereof, it is not intended that such details act as limitations upon the scope of the invention. The invention is limited only as here claimed.

What is claimed is:

1. A method for removing gunpowder residues from metal surfaces comprising applying to the residues an effective amount of a cleaning solution comprising:

93 to 99.5% by weight of an aqueous solution of from about 1 to 5% by weight of a peroxide oxidizing agent, 0.5 to 3% by weight of a liquid detergent surfactant, 0 to 1% by weight of a scenting agent, and 0.5 to 3% by weight of an alcohol.

2. The method according to claim 1 wherein the oxidizing agent is a 3% by weight aqueous solution of hydrogen peroxide.

3. The method of claim 1 wherein the liquid detergent surfactant is sodium dodecyl sulfate or sodium lauryl sulfate.

4. The method of claims wherein the scenting agent is a citrus oil.

5. The method of claim 1 wherein the cleaning solution further contains a rust inhibiting effective amount of citric acid.

6. The method of claim 1 further comprising applying the cleaning solution to the firearm with a mild abrasive action.

* * * * *